US012606986B2

(12) United States Patent
Kenkel et al.

(10) Patent No.: US 12,606,986 B2
(45) Date of Patent: Apr. 21, 2026

(54) MACHINE DAMAGE AVOIDANCE USING VISION SYSTEM INTEGRATION

(71) Applicant: Deere & Company, Moline, IL (US)

(72) Inventors: Aaron R. Kenkel, Hazel Green, WI (US); Giovanni A. Wuisan, Epworth, IA (US)

(73) Assignee: DEERE & COMPANY, Moline, IL (US)

( * ) Notice: Subject to any disclaimer, the term of this patent is extended or adjusted under 35 U.S.C. 154(b) by 24 days.

(21) Appl. No.: 18/811,365

(22) Filed: Aug. 21, 2024

(65) Prior Publication Data

US 2026/0055578 A1 Feb. 26, 2026

(51) Int. Cl.

*E02F 9/20* (2006.01)
*E02F 9/24* (2006.01)
*E02F 9/26* (2006.01)

(52) U.S. Cl.

CPC ..... *E02F 9/2033* (2013.01); *E02F 9/24* (2013.01); *E02F 9/265* (2013.01); *E02F 9/262* (2013.01)

(58) Field of Classification Search

CPC . E02F 9/2033; E02F 9/24; E02F 9/265; E02F 9/262
USPC ..... 701/50
See application file for complete search history.

(56) References Cited

U.S. PATENT DOCUMENTS 6,047,228 A * 4/2000 Stone ..... E02F 9/2025 701/50
6,185,493 B1 * 2/2001 Skinner ..... E02F 9/2033 701/50
6,845,311 B1 * 1/2005 Stratton ..... E02F 3/847 37/417
2003/0204297 A1 * 10/2003 Griffith ..... E02F 3/84 701/50
2006/0123673 A1 * 6/2006 Glover ..... E02F 3/842 37/348
2007/0125557 A1 * 6/2007 Pecchio ..... E02F 3/847 172/4.5
2019/0024348 A1 1/2019 Hiekata
2020/0016715 A1 1/2020 Anttila
2022/0106767 A1 * 4/2022 Viergutz ..... E02F 3/437
2022/0170242 A1 * 6/2022 Maley ..... G06T 7/70
2023/0017936 A1 * 1/2023 Gentle ..... E02F 3/7645
2023/0133175 A1 * 5/2023 Czarnecki ..... G06T 7/11 701/301
2023/0175236 A1 * 6/2023 Kurth ..... E02F 3/7645 701/50

(Continued)

FOREIGN PATENT DOCUMENTS

JP 2018-095254 A2 6/2018
WO WO 2008047872 A1 2/2010

OTHER PUBLICATIONS

Extended European Search Report and Written Opinion issued in European Patent Application No. 25187212.3 dated Jan. 2, 2026, in 07 pages.

*Primary Examiner* — Muhammad Shafi
(74) *Attorney, Agent, or Firm* — Christopher J. Volkmann; KELLY, HOLT & CHRISTENSON PLLC

(57) ABSTRACT

A work machine includes an implement that carries an object. A vision system detects the endpoints of the object relative to the implement and provides those endpoints to a damage avoidance control system. The damage avoidance control system generates control signals to avoid a collision between the object and a part of the work machine.

13 Claims, 12 Drawing Sheets

(56) References Cited

U.S. PATENT DOCUMENTS

2023/0340755 A1* 10/2023 Steinlage ..... E02F 9/265
2023/0389458 A1* 12/2023 Ekhe ..... G05D 1/0274

* cited by examiner

MACHINE DAMAGE AVOIDANCE USING VISION SYSTEM INTEGRATION

FIELD OF THE DESCRIPTION

The present description relates to work machines. More specifically, the present description relates to using a vision system to perform damage avoidance control of the work machine.

BACKGROUND

There are many different types of work machines. Some such work machines include excavators, loaders, knuckle boom loaders, forestry harvesters, among others.

Many work machines can be coupled to an implement that is capable of carrying objects of unknown size. For instance, a loader may include a grapple that is used to carry logs. An excavator may also include a grapple or other implement that can carry logs, pipes, or other objects. Similarly, tree harvesters or forestry harvesters can carry a tower with actuatable arms that are configured to hold and move trees after they are harvested. Similarly, many work machines may include a bucket that can be used to move rocks or other objects that extend out beyond the periphery of the bucket.

The discussion above is merely provided for general background information and is not intended to be used as an aid in determining the scope of the claimed subject matter.

SUMMARY

A work machine includes an implement that carries an object. A vision system detects the endpoints of the object relative to the implement and provides those endpoints to a damage avoidance control system. The damage avoidance control system generates control signals to avoid a collision between the object and a part of the work machine.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
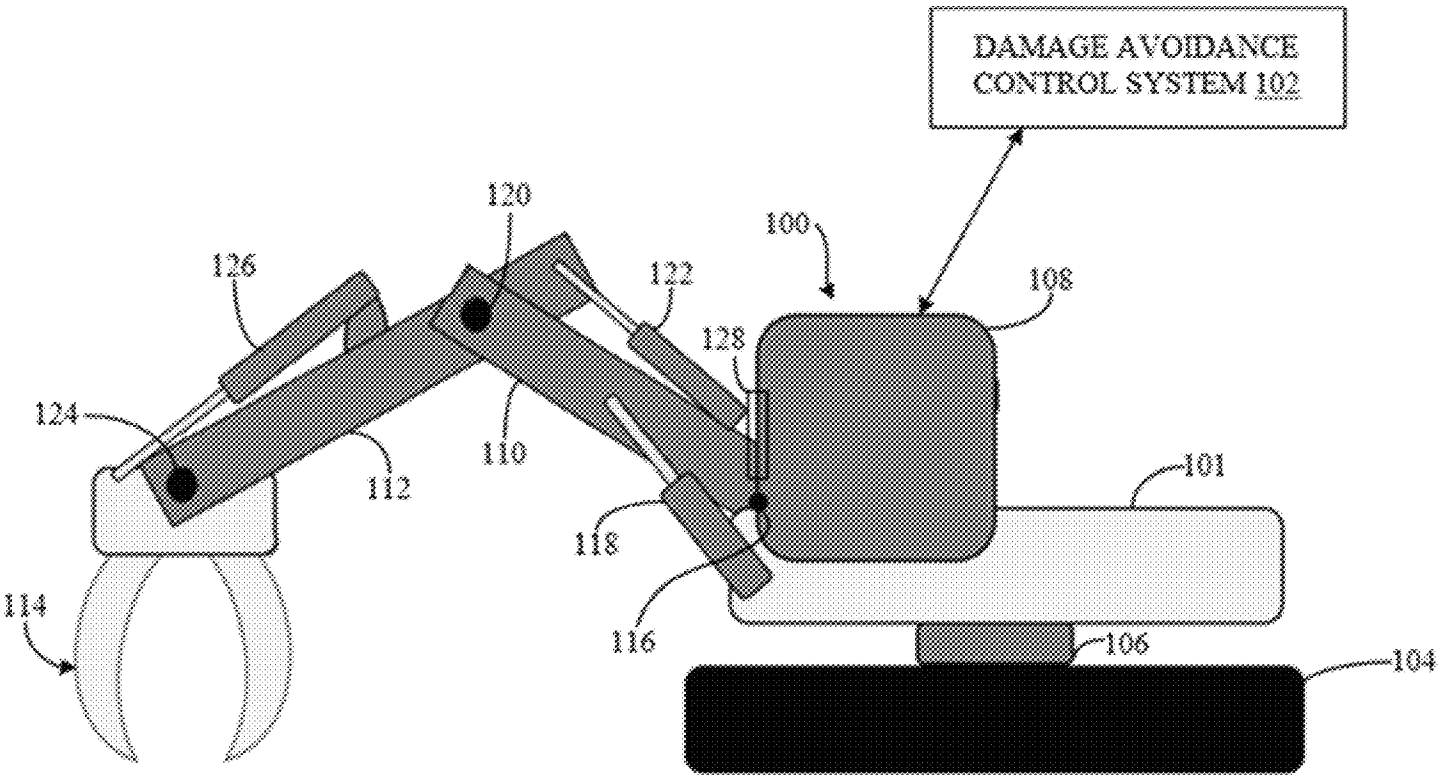
FIG. 1 is a pictorial illustration of one example of a work machine that uses joint angle measurement sensors to perform damage avoidance.

For the purposes of promoting an understanding of the principles of the present disclosure, reference will now be made to the examples illustrated in the drawings, and specific language will be used to describe the same. It will nevertheless be understood that no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, and/or steps described with respect to one example may be combined with the features, components, and/or steps described with respect to other examples of the present disclosure.

As discussed above, there are a wide variety of different types of work machines that include or may be connected to implements for carrying objects. The work machine may be controllable so that the implement may collide or otherwise damage a part of the work machine. For instance, with an excavator that is coupled to a bucket, the excavator may be operated so that the bucket can come into contact with the tracks of the excavator, the operator compartment of the excavator, etc.

Some current systems attempt to address this problem by implementing sensors on the work machine that generate sensor signals that can be used by a controller to track the position of the implement in three dimensional (3D) space in real time or in near real time. When the position of the implement is known with respect to other portions of the work machine, this information can be used to avoid collisions between the implement and other portions of the work machine.

However, many implements are configured to carry objects of unknown size. For instance, an excavator may have a grapple for carrying one or more logs. Thus, even in cases where the excavator is fitted with a damage avoidance system that uses position sensing and kinematic information to identify the location of the grapple, and thus to avoid collisions between the grapple and one of the tracks (for instance), this does not help to avoid collisions between the object carried by the grapple (e.g., the log) and the tracks or other parts of the work machine.

Thus, the present description proceeds with respect to a system that uses a vision system on board the work machine to augment the kinematic sensing and measurement system in order to infer or estimate a measured position of objects being carried by the implement. The present system further identifies points on the carried object and calculates the proximity of those points to the implement. Those points can be used by the kinematic sensing and measurement system to identify the position of the object, as the object is being moved by the work machine and the implement, in order to avoid the carried object from contacting another part of the work machine.

FIG. 1 is a partial pictorial, partial schematic, diagram of a work machine 100 in the form of an excavator, with a damage avoidance control system 102. Damage avoidance control system 102 can be a kinematic sensing and measurement system that is fully deployed on work machine 100, partially deployed on work machine 100 and partially deployed on a remote server environment, or deployed in other ways.

In the example shown in FIG. 1, excavator 100 includes an upper house 101 and an under carriage 104, with a plurality of tracks. The upper house 101 is rotatable relative to under carriage 104 about a swivel joint 106. Upper house 101 includes an operator compartment 108 and a plurality of rigid bodies 110 and 112, that are coupled to an implement 114 (shown in FIG. 1 as a grapple). Rigid body 110 is pivotable relative to the upper house 101 about pivot point 116. Pivotal movement of rigid body 110 about pivot point 116 is driven by one or more actuators 118. Rigid body 112 is pivotable relative to rigid body 110 about pivot point 120. Pivotal movement of rigid body 112 about pivot point 120 is driven by one or more actuators 122. Implement 114 is pivotable relative to rigid body 112 about pivot point 124. Pivoting movement of implement 114 about pivot point 124 is driven by actuation of one or more actuators 126. In the example shown in FIG. 1, measurement of the pivot angles of the rigid bodies is measured by an angular position sensor deployed in each of the joints or pivot points 116, 120, and 124. In another example, inertial measurement units or accelerometers or other devices can be mounted to house 101 to track the orientation of house 101 and/or other chassis of machine 100, as well as to the rigid bodies 110, 112 to track the angular position of the rigid bodies 110, 112 relative to one another and relative to house 101 and/or the chassis as a function of measured accelerations and position relative to gravity. Damage avoidance control system 102 can identify the position of implement 114 based upon a combination of the known pin-to-pin lengths of the rigid bodies 110, 112, the known dimensions of implement 114, and the measured joint angles. Damage avoidance control system 102 generates a kinematic chain to track the position of implement 114 relative to the upper house 101 and under carriage 104 (as well as operator compartment 108) of machine 102.

In the example shown in FIG. 1, work machine 100 also includes a vision system 128. Vision system 128 can be one or more stereo cameras, an infrared (IR) system, a radio detection and ranging (RADAR) sensor, a light detection and ranging (LIDAR) sensor, an ultrasonic sensor, or another sensor that has a field of view oriented to sense an object carried by implement 114. Vision system 128 can detect the presence of an object being carried by implement 114 and identify the measurements or end points of that object in 3D space or relative to implement 114. Damage avoidance control system 102 then provides those endpoints to a control signal generator that controls the actuators on machine 100 to avoid contact between the object being carried by implement 114 and any protected parts of the work machine 100.

Figure 2:
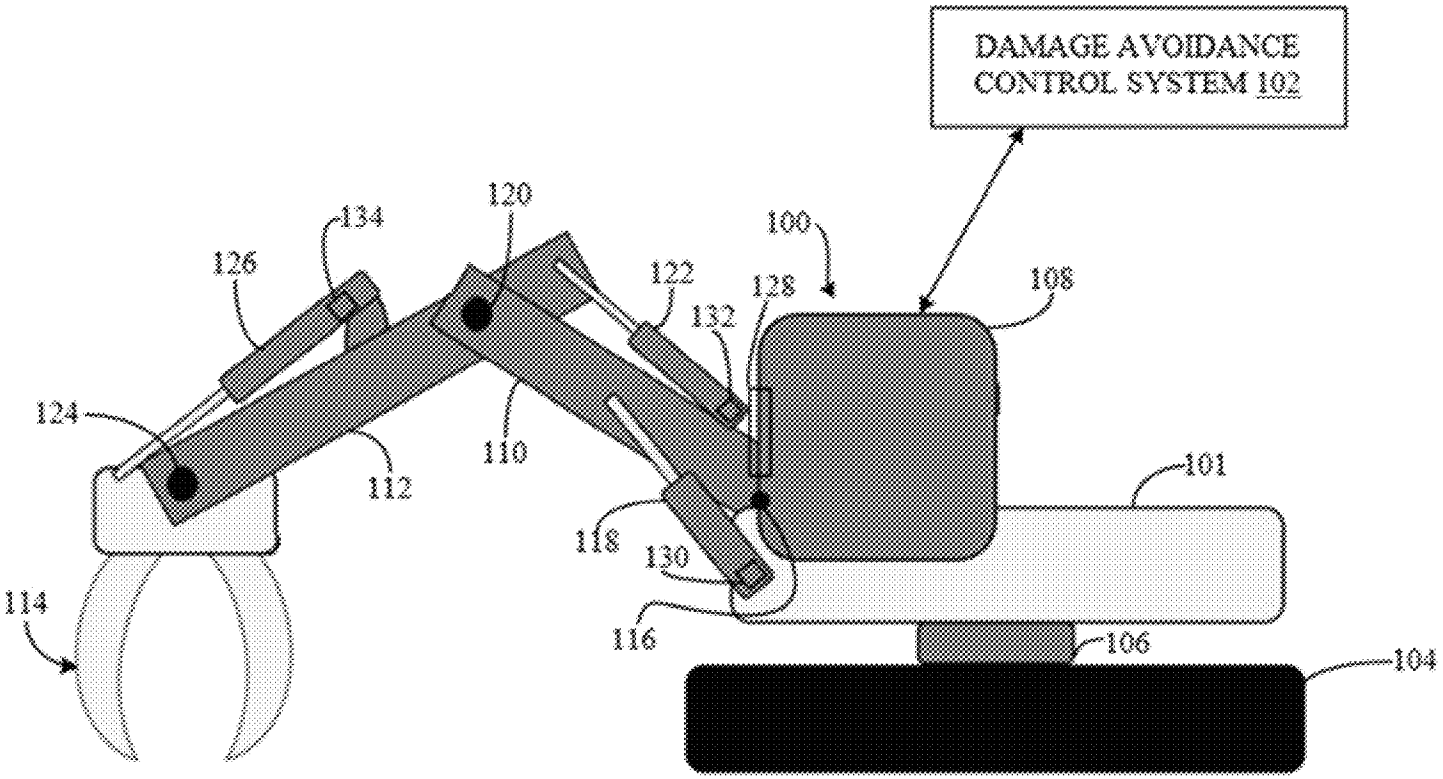
FIG. 2 is a pictorial illustration of one example of a work machine that uses actuator length sensors to perform damage avoidance.

FIG. 2 is similar to FIG. 1, and similar items are similarly numbered. However, in FIG. 2, instead of sensing the position of rigid members 110 and 112 as well as implement 114 in 3D space using angular sensors at joints 116, 120, and 124, the system shown in FIG. 2 uses a set of cylinder position sensors 130, 132, and 134 that sense the position of actuators 118, 120, and 126, respectively. Thus, sensors 130, 132, and 134 can be internal position sensors that sense the position of the rod of each of the actuators 118, 122, and 126 relative to the base. In another example sensors 130, 132, and 134 can be linear position sensors that sense the linear position of the actuators (e.g., the extent of actuation of the actuators) 118, 122, and 126. In the architecture shown in FIG. 2, the combination of the measured cylinder lengths and known joint positions allows a kinematic chain to be established by damage avoidance control system 102 to track the position of implement 114 in 3D space relative to upper house 101, relative to under carriage 104, or relative to other parts of the machine chassis of work machine 100. As shown in FIG. 1, FIG. 2 illustrates a vision system 128 that has a field of view that can capture an object carried by implement 114. Points on the object are identified by damage avoidance control system 102 to define the volume of the object being carried (or its periphery) and the points furthest away from implement 114 on the object can be identified as the endpoints of the object. Damage avoidance control system 102 can then track the location of those endpoints in three-dimensional space and control the actuators 118, 122, 126, swivel 106, or other actuators to avoid contact between the object being carried by implement 114 and other parts of machine 100.

Figure 3:
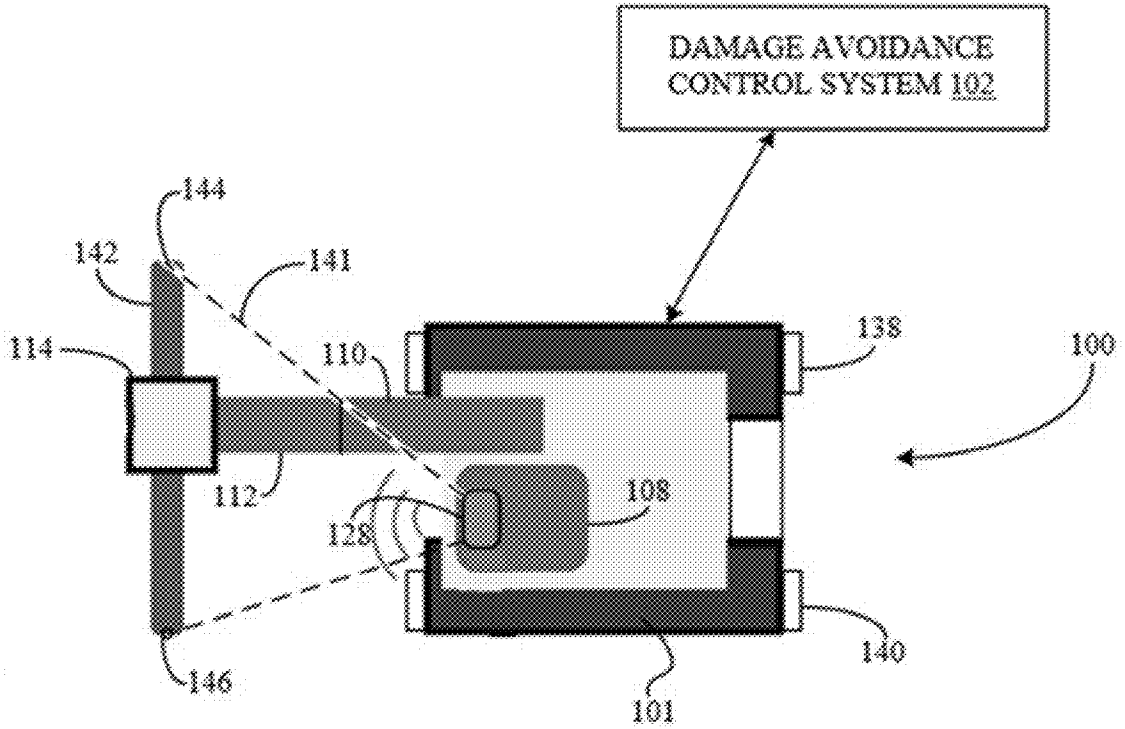
FIG. 3 is a pictorial top view of one example of an excavator with an implement that is carrying an object.

FIG. 3 is a partial pictorial, partial schematic top view of work machine 100 and damage avoidance control system 102. Some items in FIG. 3 are similar to those shown in FIGS. 1 and 2 and those items are similarly numbered. FIG. 3 specifically shows that under carriage 104 has a set of tracks 138 and 140. FIG. 3 also shows that implement 114 is illustrated carrying an object 142 of unknown length. In the example shown in FIG. 3, it is assumed that object 142 is a pipe or log.

In the example shown in FIG. 3, vision system 128 first captures an image in field of view 141 and generates an output or signal indicative of that image. Damage avoidance and control system 102 determines that implement 114 is carrying an object 142. In order to do so, system 102 can identify the periphery (or known envelope) of implement 114 and the position of that known envelope in 3D space. Then, based upon the images captured by vision system 128, damage avoidance control system 102 can identify points of an object that are outside the periphery or known envelope of implement 114, but that are within a target proximity (e.g., within several inches) of the periphery or known envelope of implement 114. This placement indicates that an object is present that is separate from implement 114, but that is so close to implement 114 that it can be inferred that implement 114 is carrying that object.

When an object is being carried by implement 114, then based upon the images captured by vision system 128, damage avoidance control system 102 can detect a plurality of points on object 142 to define the volume or periphery corresponding to object 142. Based upon that information, damage avoidance control system 102 can identify the points on object 142 that are offset the furthest from implement 114 in both directions along the longitudinal axis of object 142. These points will then correspond to endpoints on or closely proximate the extreme ends 144, 146, of object 142. Using a kinematic chain that can be established based upon the location of points 144 and 146 relative to implement 114, and based upon the angles and dimensions of rigid bodies 110 and 112, and further based upon the location of implement 114 in 3D space, damage avoidance control system 102 can track the location of endpoints 144, 146 of object 142 as those points 144, 146 are moved by actuators on work machine 100. When those points come within a target proximity of the chassis (upper house 101, under carriage 104, tracks 138, 140, etc.) of work machine 100, then damage avoidance control system 102 can generate a control signal to control the actuators or other elements of machine 100 in order to avoid contact between object 142 and protected parts of machine 100 or any other parts of machine 100. Because damage avoidance control system 102 knows the offset of the end points 144, 146 from implement 114 (the distance and direction that points 144 and 146 are located from the periphery of implement 114), damage avoidance control system 102 can continuously infer or estimate the position of object 142 in the event that object 142 passes out of the field of view 141 of vision system 128 (e.g., when part or all of object 142 is blocked by machine 100 or another machine, is blocked by debris in the work area of machine 100, etc.).

Figure 4:
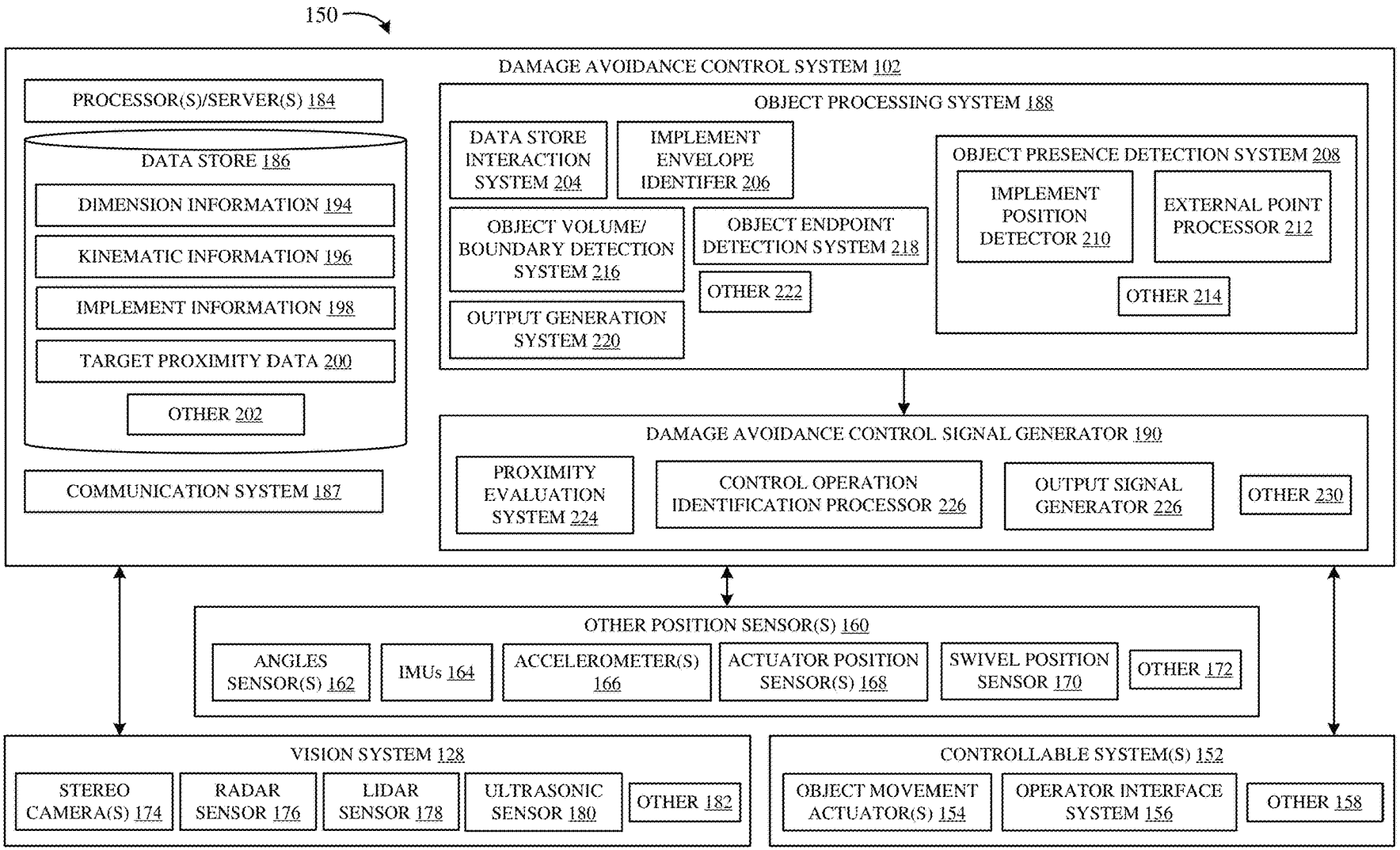
FIG. 4 is a block diagram of one example of a damage avoidance control system in more detail.

FIG. 4 is a block diagram showing one example of a damage avoidance architecture 150. Damage avoidance architecture 150 includes damage avoidance control system 102, vision system 128, other sensors 160, and controllable system(s) 152. Based upon inputs from vision system 128, damage avoidance control system 102 generates control signals to control one or more controllable systems 152. The controllable systems 152 can include object movement actuators 154 which are actuated to move object 142. Such actuators can include any of the actuators described above with respect to FIGS. 1-3 or other actuators (such as the actuator that actuates swiveling movement of upper house 101 relative to under carriage 104 or other actuators). The controllable systems 152 can also include an operator interface system 156 and other items 158. Operator interface system 156 may include operator interface mechanisms that are used to provide audio, visual, and/or haptic information to an operator and/or mechanisms that are used to receive inputs from an operator. Thus, operator interface system 156 can include joysticks, a steering wheel, pedals, levers, buttons, a display screen, a microphone and/or speaker, items displayed on a display screen that can be actuated by the operator such as icons, links, buttons, menus, etc., and any of a wide variety of other mechanisms that can be used to provide information to an operator and to receive inputs from the operator. Other position sensors 160 can include the other sensors that sense the position of rigid bodies 110, 112, and implement 114, such as angle sensors 162 (which can include sensors that sense the angles of the rigid bodies about pivot points 116, 120 and 124), inertial measurement units (IMUs) 164, accelerometers 166, actuator position sensors 168 (which can be sensors 130, 132, and 134 shown in FIG. 2 or other sensors), swivel position sensor 170 (which senses the angular position of swivel 106), and/or any of a wide variety of other sensors 172.

Vision system 128 can include one or more stereo cameras 174, one or more RADAR sensor systems 176, one or more LIDAR sensor systems 178, one or more ultrasonic sensor systems 180, and/or one or more other sensor systems 182. In the example shown in FIG. 4, damage avoidance control system 102 can include one or more processors or servers 184, data store 186, communication system 187, object processing system 188, damage avoidance control signal generator 190, and any of a wide variety of other control system functionality 192. Data store 186 can store dimension information 194, kinematic information 196, implement information 198, target proximity data 200, and other items 202. Object processing system 188 can include data store interaction system 204, implement envelope identifier 206, object presence detection system 208 (which, itself, can include implement position detector 210, external point processor 212, and other items 214), object volume/boundary detection system 216, object endpoint detection system 218, output generation system 220, and other items 222. Damage avoidance control signal generator 190 can include proximity evaluation system 224, control operation identification processor 226, output signal generator 228, and other items 230. Before describing the overall operation of damage avoidance architecture 150 in more detail, a description of some of the items in architecture 150, and their operation, will first be provided.

Dimension information 194 can include any dimension information corresponding to machine 100 and implement 114. For instance, dimension information 194 may include the pin-to-pin measurements of rigid bodies 110, 112, as well as the dimensions of implement 114. Dimension information 194 may include the dimensions of items on under carriage 104, and upper house 101, as well as the dimensions of operator compartment 108, and any of a wide variety of other dimensions. Kinematic information 196 can define the movements of rigid bodies 110 and 112 and implement 114 based upon the actuation of actuators 118, 122, and 126. Kinematic information 196 can also describe the movement of the rigid bodies and implement, as well as other portions of machine 100, based upon actuation of swivel 106 and/or other actuators.

Implement information 198 may include additional information about implement 114, such as information that defines the movement of jaws on a grapple when those jaws are actuated, or other implement information that can be used to identify the location of implement 114 in three-dimensional space, and/or relative to a reference portion of machine 100.

Target proximity data 200 may include data that defines how close a point needs to be to implement 114 in order to infer that implement 114 is carrying an object that includes that point. Target proximity data 200 may also include proximity data indicating how closely a part of object 142 must come to another portion of machine 100 in order for damage avoidance control operations to be performed (such as to stop movement of object 142, to slow down movement of object 142, to alert the operator, etc.). Data store 186 can store any of a wide variety of other data 202.

Communication system 187 illustratively facilitates the communication of items in architecture 150 relative to one another, and may also facilitate communication with a remote system, another machine, or other system over a network. Thus, communication system 187 may facilitate downloading of any of the information in data store 106, or communication of other information. Communication system 187 can thus include a controller area network (CAN) bus and bus controller, a cellular communication system, a Wi-Fi, Bluetooth, or near field communication system, a wide area network or local area network communication system, or any of a wide variety of other systems or combinations of systems.

Object processing system 188 receives input from vision system 128 and determines whether implement 114 is carrying an object. If so, object processing system 188 defines the volume or envelope or periphery corresponding to that object, and/or identifies the endpoints of the object. That information is provided to damage avoidance control signal generator 190.

More specifically, data store interaction system 204 in object processing system 188 can interact with data store 186 to obtain access to any of the information in data store 186. Implement envelope identifier 206 can identify the location and periphery of implement 114 in three-dimensional space given the dimension information 194, kinematic information 196, and/or implement information 198 and/or other information. Implement envelope identifier 206 may generate a kinematic chain of known points in order to compute the location of implement 114 in 3D space or perform in other ways.

Object presence detection system 208 determines whether implement 114 is carrying an object. In one example, implement position detector 210 detects the position of implement 114 in 3D space and external point processor 212 processes the inputs from vision system 128 to identify points that are external to implement 114 but that are close enough to implement 114 (e.g., within a target proximity of implement 114) to be considered an object that is being carried by implement 114. Similarly, external point processor 212 can track the location of those points as implement 114 moves to determine whether those points move in a corresponding way. If so, then object presence detection system 208 can generate an output indicating that implement 114 is indeed carrying an object. If there are no points external to the periphery of implement 114, but within the target proximity of implement 114, or if those points do not move in a corresponding way as implement 114 moves, then object presence detection system 208 can generate an output indicating that implement 114 is not carrying an object.

In addition, it may be that implement 114 is in a position where no object can be detected. For instance, if implement 114 is engaging the ground (such as if implement 114 is a bucket or other element that may engage the ground) then image position detector 210 generates an output indicating that implement 114 is in a position where detection of an object carried by implement 114 will not be performed. In another example, it may be that machine 100 is lowering implement 114 over a wall or into a hole, or behind another obscurant so that vision system 128 cannot detect any objects that might be picked up by implement 114. In any of these cases, object presence detection system 208 generates an output indicating that implement 114 is in a position where object detection will not be performed.

Assuming that system 208 provides an output indicating that implement 114 is carrying an object, then object volume/boundary detection system 216 processes the information from vision system 128 to identify a volume, or an area, or a periphery of the object being carried by implement 114. System 216 can do this by identifying continuous points (points spaced within a desired proximity of one another) outside of implement 114 that can be attributed to the object being carried by implement 114. The outer points can be used to define the boundary or periphery of the object being carried.

Object endpoint detection system 218 then uses the detected points to identify those points that are located furthest from implement 114 in three-dimensional space, on both sides of implement 114 (e.g. along the longitudinal axis of the object 142 being carried). Such points are identified as the endpoints which define the ends 144 and 146 of the object 142 being carried by implement 114. Output generation system 220 then generates an output indicating the location of the endpoints of the object 142 relative to implement 114 to damage avoidance control signal generator 190. Damage avoidance control signal generator 190 can process the endpoints as an extension of implement 114, or track the position of the endpoints 144, 146 separately from implement 114 by building a kinematic chain of points, or process those endpoints in other ways. Proximity evaluation system 224 can continuously evaluate the location of the endpoints 144, 146 relative to protected portions of machine 100 (such as the chassis, upper house 101, operator compartment 108, under carriage 104, tracks 138 and 140, or other portions) to determine whether the endpoints 144, 146 are within a target proximity of any of the protected portions of machine 100, or whether the endpoints 144, 146 are approaching the protected portions. If the endpoints 144, 146 are within a target proximity of the protected portions of machine 100, or if the endpoints are approaching those portions of machine 100, then control operation identification processor 226 can identify control operations that should be performed (such as to slow down the movement of object 142, to halt the movement of object 142, etc.). Output signal generator 228 generates a control signal to control a controllable system 152 to perform the control operation in order to avoid damage to machine 100.

Figure 5A:
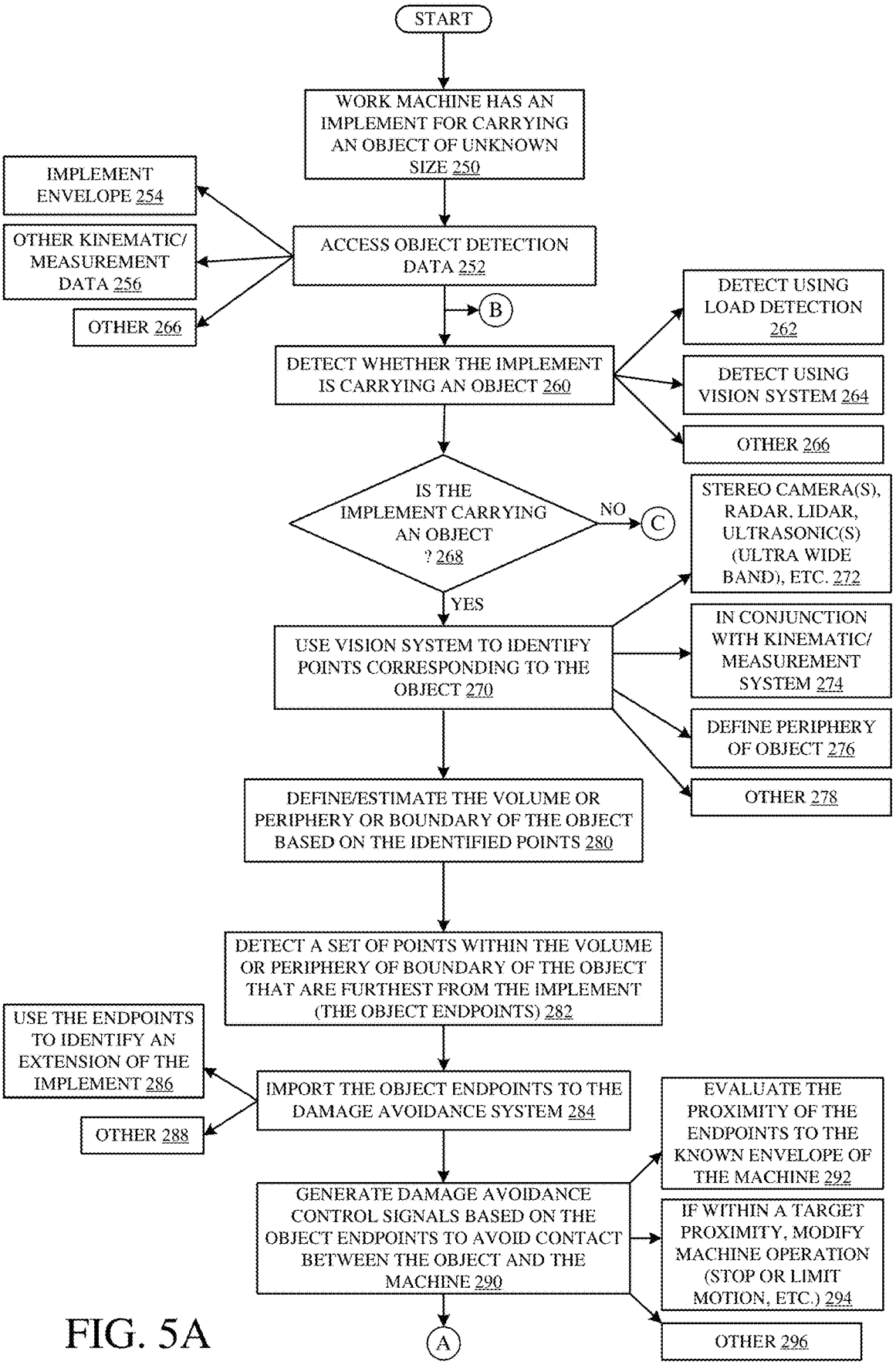
FIGS. 5A and 5B (collectively referred to herein as FIG. 5) show a flow diagram illustrating one example of the operation of the damage avoidance control system in more detail.
Figure 5B:
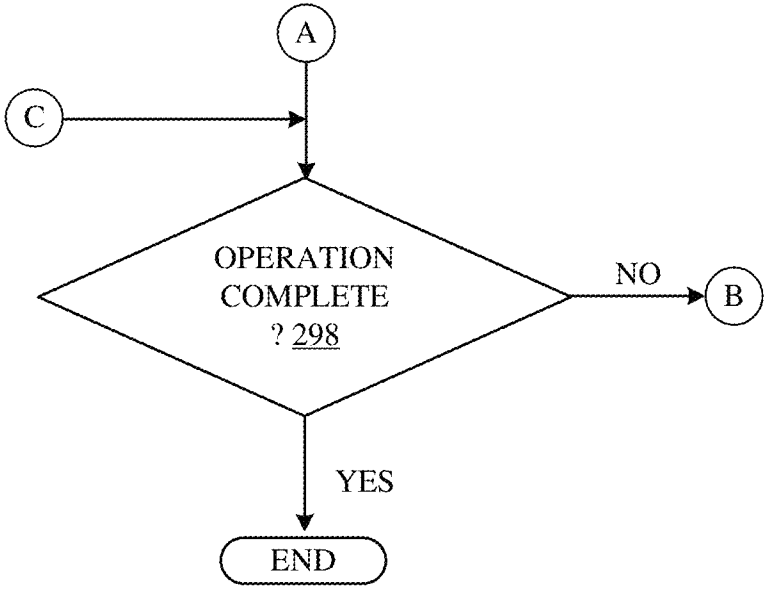

FIGS. 5A and 5B (collectively referred to herein as FIG. 5) show a flow diagram illustrating one example of the operation of damage avoidance architecture 150 in more detail.

It is first assumed that work machine 100 has an implement 114 that is configured to carry an object of unknown size, as indicated by block 250 in the flow diagram of FIG. 5. Data store interaction system 204 accesses object detection data that can be used by object processing system 188 to detect an object carried by implement 114. The object detection data can also be input by an operator or in other ways. Accessing the object detection data is indicated by block 252 in the flow diagram of FIG. 5. The object detection data may include dimension information 194, kinematic information 196, implement information 198 or other information that is used to identify the envelope or periphery or boundaries corresponding to implement 114. Identifying the implement envelope from the object detection data is indicated by block 254 in the flow diagram of FIG. 5. Obtaining other kinematic and/or measurement data is indicated by block 256. Other object detection data can be obtained in other ways as well, as indicated by block 258.

In one example, the object detection data can be used by implement envelope identifier 206 to identify the envelope or boundary of implement 114. Object presence detection system 208 then detects whether the implement 114 is carrying an object, as indicated by block 260 in the flow diagram of FIG. 5. In one example, object presence detection system 208 receives an input from a load detection system that may measure a load carried by implement 114 to indicate that implement 114 is carrying an object. Detecting that implement 114 is carrying an object based on an input from a load detection system is indicated by block 262 in the flow diagram of FIG. 5. Object presence detection system 208 can also detect whether implement 114 is carrying an object using inputs from vision system 128, as indicated by block 264 in the flow diagram of FIG. 5. Object presence detection system 208 can detect whether implement 114 is carrying an object in other ways as well, as indicated by block 266. For example, implement position detector 210 illustratively identifies the position of implement 114 in space, or relative to a reference point on machine 100, or in another way. External point processor 212 identifies points (in the image represented by the vision system received by vision system 128) that are outside of the implement envelope (identified by implement envelope identifier 206 and located based upon implement position detector 210) but that are within a target proximity of implement 114, meaning that they are close enough to correspond to an object that is carried by implement 114. Identifying the presence of an object using implement position detector 210 and external point processor 212 is described in greater detail below with respect to FIG. 6.

If object presence detection system 208 determines that implement 114 is carrying an object, as determined at block 268 in the flow diagram of FIG. 5, then object volume/boundary detection system 216 receives inputs from vision system 128 to identify a set of points corresponding to the object, as indicated by block 270. As discussed above with respect to FIG. 4, vision system 128 can include one or more stereo cameras 174, a RADAR sensor system 176, a LIDAR sensor system 178, an ultrasonic sensor system 180, or other vision sensors 182, as indicated by block 272 in the flow diagram of FIG. 5. Identifying points corresponding to the object can be done in conjunction with the kinematic/measurement data 194, 196, 198, and 200, as indicated by block 274 in the flow diagram of FIG. 5. Object volume/boundary detection system 216 can define the boundary of the object as indicated by block 276, or define other spatial characteristics of the object, as indicated by block 278.

In one example, object volume/boundary detection system 216 receives an input from vision system 128 and processes that input to identify points represented in the input from vision system 128 that are close to implement 114, but outside the periphery of implement 114, indicating that those points correspond to an object being carried by implement 114. Object volume/boundary detection system 216 can compare the position of those points to the position of other points (such as in the background or other points further spaced from implement 114, which lie outside the object and are identified as not corresponding to the object). By identifying a set of points corresponding to the object (or that lie on the object), and by identifying points that lie outside of the object, object volume/boundary detection system 216 can identify points that indicate the volume or boundary or other periphery of the object being carried by implement 114.

Defining or estimating the volume or periphery of the object based upon the identified points is indicated by block 280 in the flow diagram of FIG. 5.

Once the volume, periphery, or boundary of the object is identified, then object endpoint detection system 218 detects a set of points within that volume or periphery or boundary that are furthest from implement 114. Such points will represent the object endpoints (such as points corresponding to the ends 144, 146 of object 142 discussed above with respect to FIG. 3). Detecting the set of points corresponding to the object endpoints is indicated by block 282 in the flow diagram of FIG. 5.

Output generation system 220 then generates an output indicative of the object endpoints and provides that output to damage avoidance control signal generator 120, as indicated by block 284 in the flow diagram of FIG. 5. In one example, damage avoidance control signal generator 190 may redefine the envelope of implement 114 to extend out to the endpoints of the object. Thus, damage avoidance control signal generator 190 can perform damage control operations to avoid having the implement 114 (as extended by object 142) collide with other parts of machine 100. Using the endpoints to identify an extension of the implement 114 is indicated by block 286 in the flow diagram of FIG. 5. Damage avoidance control signal generator 190 can process the object endpoints in other ways as well, as indicated by block 288.

Damage avoidance control signal generator 190 then generates damage avoidance control signals based upon the object endpoints. The control signals control machine 100 to avoid contact between the object and the machine 100, as indicated by block 290 in the flow diagram of FIG. 5. In one example, proximity evaluation system 224 evaluates the proximity of the endpoints to the known envelope of machine 100 (or to the known envelope or boundaries of protected portions of machine 100) as indicated by block 292 in the flow diagram of FIG. 5. If proximity evaluation system 224 determines that the endpoints are within a target proximity of the protected portions of machine 100, then damage avoidance control signal generator 190 can generate control signals to modify the operation of the machine 100 to avoid damage, as indicated by block 294 in the flow diagram of FIG. 5.

For instance, control operation identification processor 226 can identify a damage control operation to perform based upon the evaluation of the endpoints output by system 224. The damage control operation may be to stop movement of the implement 114 and object 142, to limit that motion to avoid a collision with machine 100, to slow down movement of implement 114 and object 142, to generate an output on operator interface system 156, or other operations, as indicated by block 296.

Output signal generator 228 can generate a control signal to control any of the controllable systems 152, or other systems, based upon the damage control operation identified by processor 226. Thus, the control signal can control object movement actuators 154 or other actuators on machine 100. The control signal can control an operator interface system 156, or other systems 158.

Until operation is complete, as determined at block 298 in the flow diagram of FIG. 5, operation reverts to block 260 where the system continues to detect whether the implement 114 is carrying an object.

Figure 6:
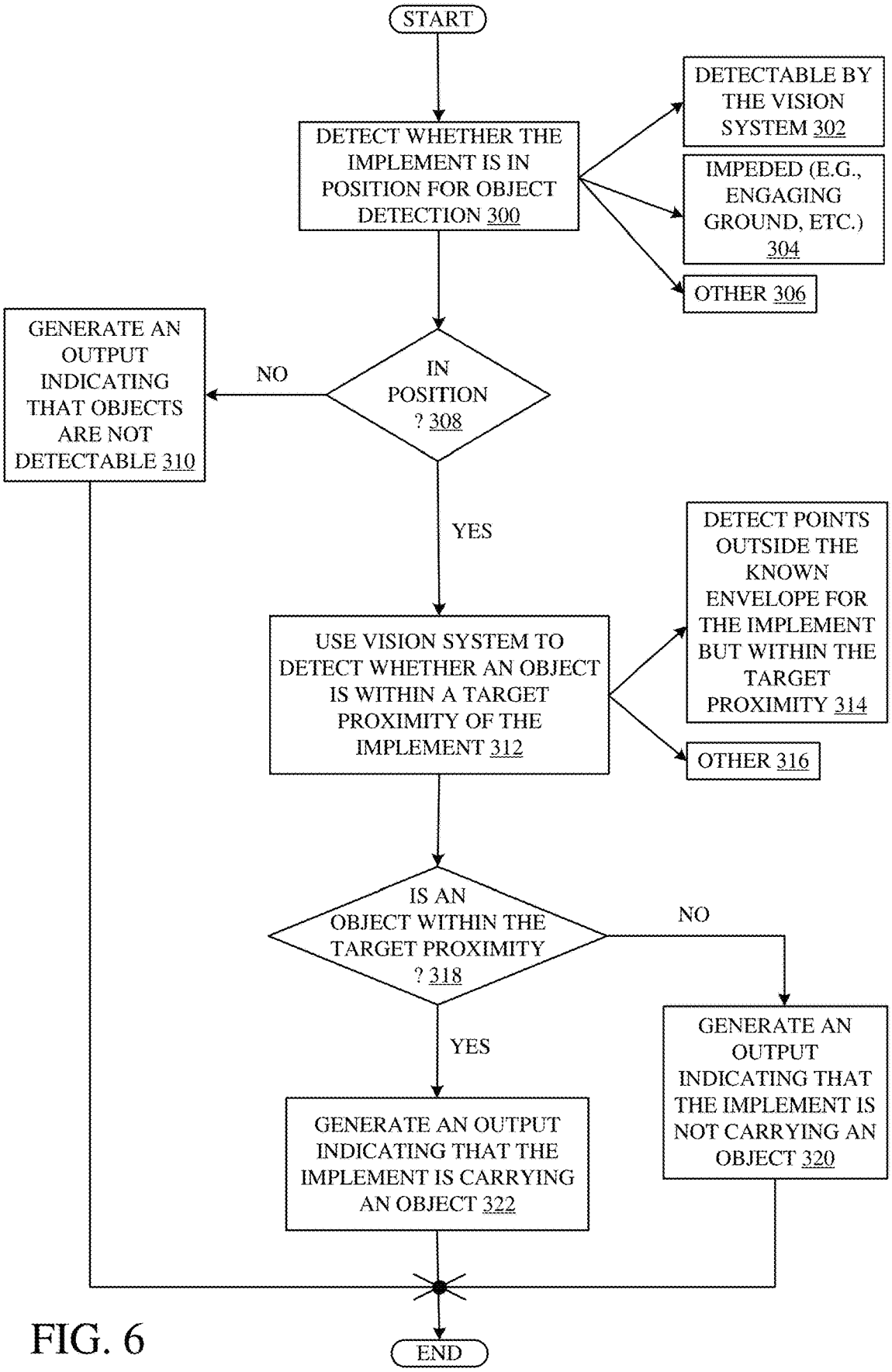
FIG. 6 is a flow diagram showing one example of the operation of an object presence detection system in more detail.

FIG. 6 is a flow diagram illustrating one example of the operation of object presence detection system 208 in using inputs from vision system 128 to detect whether implement 114 is carrying an object. Implement position detector 210 first detects whether the implement 114 is in a position where an object can be detected, as indicated by block 300 in the flow diagram of FIG. 6. For instance, implement position detector 210 may determine whether the implement 114 is detectable by the vision system or whether an object that is carried by implement 114 is detectable by the vision system, as indicated by block 302. By way of example, where implement 114 is closely proximate, or in engagement with, the ground, then it may be difficult for vision system 128 to provide an output identifying a carried object, as opposed to the ground. Similarly, it may be that the field of view of vision system 128 is impeded (such as by a dirt pile, a debris pile, a wall, or other impediment) as indicated by block 304 in the flow diagram of FIG. 6. Implement position detector 210 may detect whether the implement 114 is in position for object detection in other ways as well, as indicated by block 306.

If implement position detector 210 determines that implement 114 is not in a position so that an object can be detected (as determined by block 308 in the flow diagram of FIG. 6), then object presence detection system 208 generates an output indicating that objects are not detectable (or are not being detected) as indicated by block 310.

However, if, at block 308, it is determined that implement 114 is in a position so that an object 142 can be detected by vision system 128, then external point processor 212 processes the inputs from vision system 128 to detect whether an object 142 is within a target proximity of implement 114, so that the object 142 can be determined to be carried by implement 114. Using the vision system 128 to detect whether an object is within a target proximity of implement 114 is indicated by block 312 in the flow diagram od FIG. 6. In one example, external point processor 212 identifies points in the signal received from vision system 128 that are outside the known envelope or periphery of implement 114, but are within the target proximity of implement 114, as indicated by block 314. If the points are outside the periphery or envelope of implement 114, but are inside the target proximity, this means that those points are so close to implement 114 that they can be characterized as lying on or corresponding to an object that is being carried by implement 114. External point processor 212 can process the external points identified based upon the signal from vision system 128 in other ways as well, in order to detect whether implement 114 is carrying an object, as indicated by block 316 in the flow diagram of FIG. 6.

If external point processor 212 determines that there are no points corresponding to an object within the target proximity of implement 114 (as determined at block 318 in the flow diagram of FIG. 6), then object presence detection system 208 generates an output indicating that the implement 114 is not carrying an object, as indicated by block 320. However, if it is determined that there is an object within the target proximity of implement 114, then object presence detection system 208 generates an output indicating that the implement 114 is carrying an object, as indicated by block 322 in the flow diagram of FIG. 6.

The various outputs from object presence detection system 208 can also be used by damage avoidance control signal generator 190 to control a controllable subsystem 152. For instance, generator 190 can control operator interface system 156 to display an indication to the operator indicating whether implement 114 is in position for object detection, and whether an object is detected or not detected. Other control signals can be generated as well.

It can thus be seen that the present description describes a system that not only controls a machine to avoid damage which may occur when an implement 114 contacts the machine, but also controls the machine so that objects carried by the implement avoid contact with the machine. It will be noted that while a grapple 114 has been described, the present description can apply to substantially any implement. For instance, where a bucket is being used to move earth, but the bucket contains a large rock or other obstacle that protrudes beyond the periphery of the bucket, such an object can also be detected. Any of a wide variety of other implements and objects of unknown size can be detected as well.

The present discussion has mentioned processors and servers. In one example, the processors and servers include computer processors with associated memory and timing circuitry, not separately shown. The processors or servers are functional parts of the systems or devices to which they belong and are activated by, and facilitate the functionality of the other components or items in those systems.

Also, a number of user interface (UI) displays have been discussed. The UI displays can take a wide variety of different forms and can have a wide variety of different user actuatable input mechanisms disposed thereon. For instance, the user actuatable input mechanisms can be text boxes, check boxes, icons, links, drop-down menus, search boxes, etc. The mechanisms can also be actuated in a wide variety of different ways. For instance, the mechanisms can be actuated using a point and click device (such as a track ball or mouse). The mechanisms can be actuated using hardware buttons, switches, a joystick or keyboard, thumb switches or thumb pads, etc. The mechanisms can also be actuated using a virtual keyboard or other virtual actuators. In addition, where the screen on which the mechanisms are displayed is a touch sensitive screen, the mechanisms can be actuated using touch gestures. Also, where the device that displays the mechanisms has speech recognition components, the mechanisms can be actuated using speech commands.

A number of data stores have also been discussed. It will be noted the data stores can each be broken into multiple data stores. All can be local to the systems accessing the data stores, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

It will be noted that the above discussion has described a variety of different systems, components, generators, identifiers, detectors, and/or logic. It will be appreciated that such systems, components, generators, identifiers, detectors, and/or logic can be comprised of hardware items (such as processors and associated memory, or other processing components, some of which are described below) that perform the functions associated with those systems, components, generators, identifiers, detectors, and/or logic. In addition, the systems, components, generators, identifiers, detectors, and/or logic can be comprised of software that is loaded into a memory and is subsequently executed by a processor or server, or other computing component, as described below. The systems, components, generators, identifiers, detectors, and/or logic can also be comprised of different combinations of hardware, software, firmware, etc., some examples of which are described below. These are only some examples of different structures that can be used to form the systems, components, generators, identifiers, detectors, and/or logic described above. Other structures can be used as well.

Figure 7:
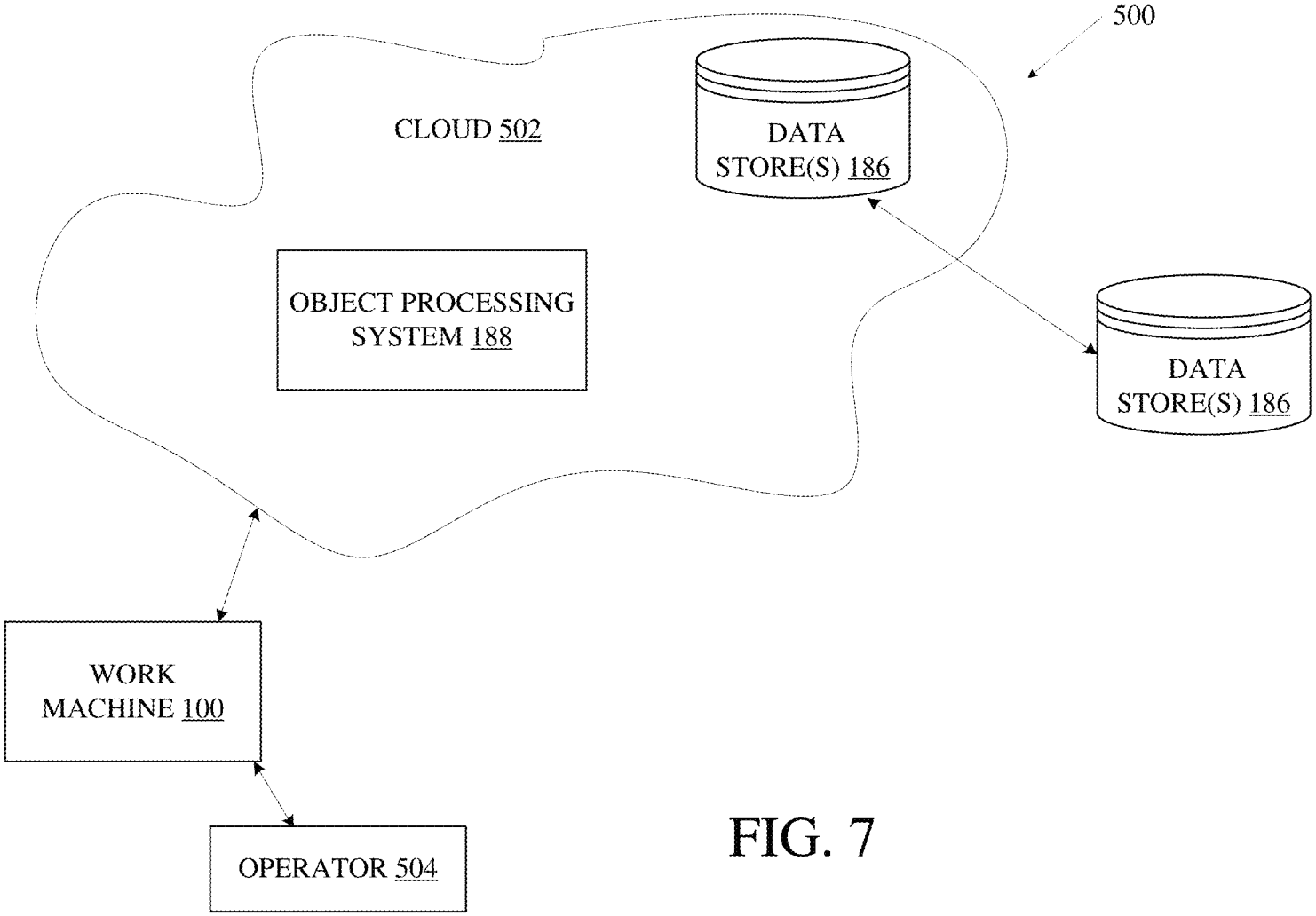
FIG. 7 is a block diagram showing one example of the damage avoidance control system deployed with respect to a remote server environment.

FIG. 7 is a block diagram of work machine 100, shown in FIG. 1, except that it communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network, and they can be accessed through a web browser or any other computing component. Software or components shown in previous FIGS. as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, the components and functions can be provided from a conventional server, or they can be installed on client devices directly, or in other ways.

In the example shown in FIG. 7, some items are similar to those shown in previous FIGS. and they are similarly numbered. FIG. 7 specifically shows that part or all of object processing system 188 and/or data store 186 can be located at a remote server location 502. Therefore, work machine 100 accesses those systems through remote server location 502. FIG. 7 also shows an operation 504 operating machine 504.

FIG. 7 also depicts another example of a remote server architecture. FIG. 7 shows that it is also contemplated that some elements of previous FIGS are disposed at remote server location 502 while others are not. By way of example, data store 186 can be disposed at a location separate from location 502, and accessed through the remote server at location 502. Regardless of where the items are located, they can be accessed directly by work machine 100, through a network (either a wide area network or a local area network), the items can be hosted at a remote site by a service, or the items can be provided as a service, or accessed by a connection service that resides in a remote location. Also, the data can be stored in substantially any location and intermittently accessed by, or forwarded to, interested parties. All of these architectures are contemplated herein.

It will also be noted that the elements of previous FIGS., or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 8:
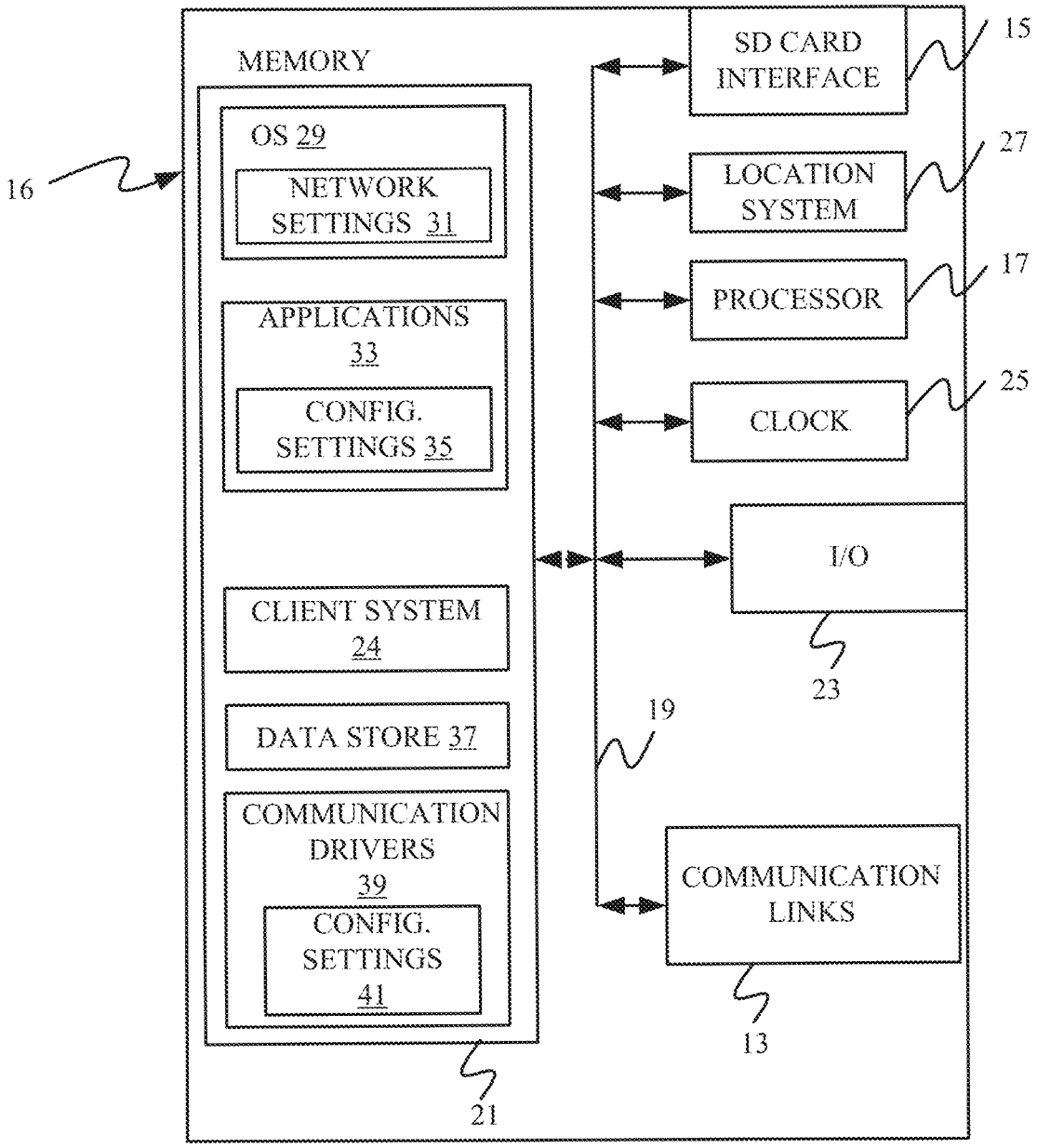
FIGS. 8, 9, and 10 show examples of mobile devices that can be used in the architectures and systems described herein.
Figure 9:
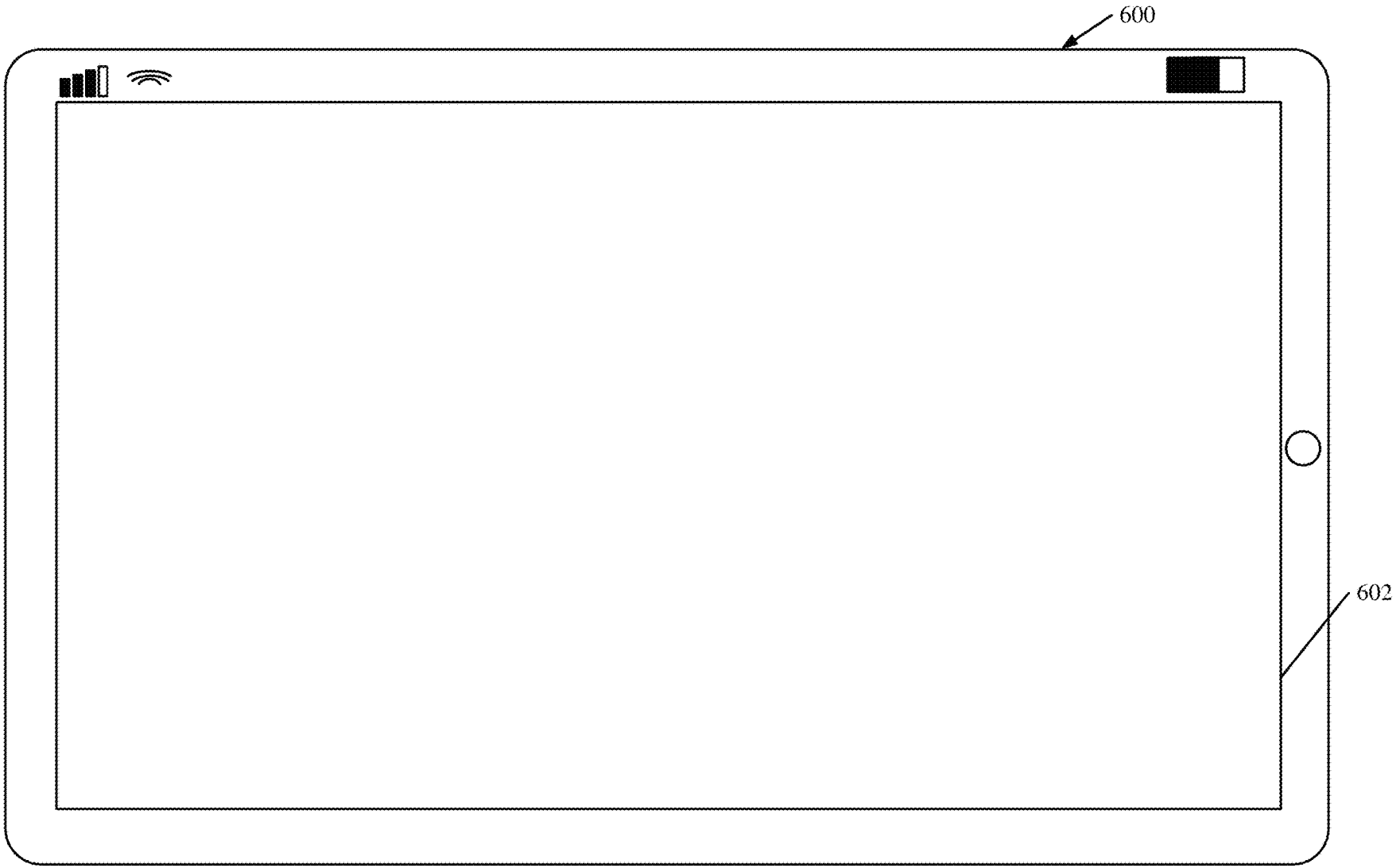
Figure 10:
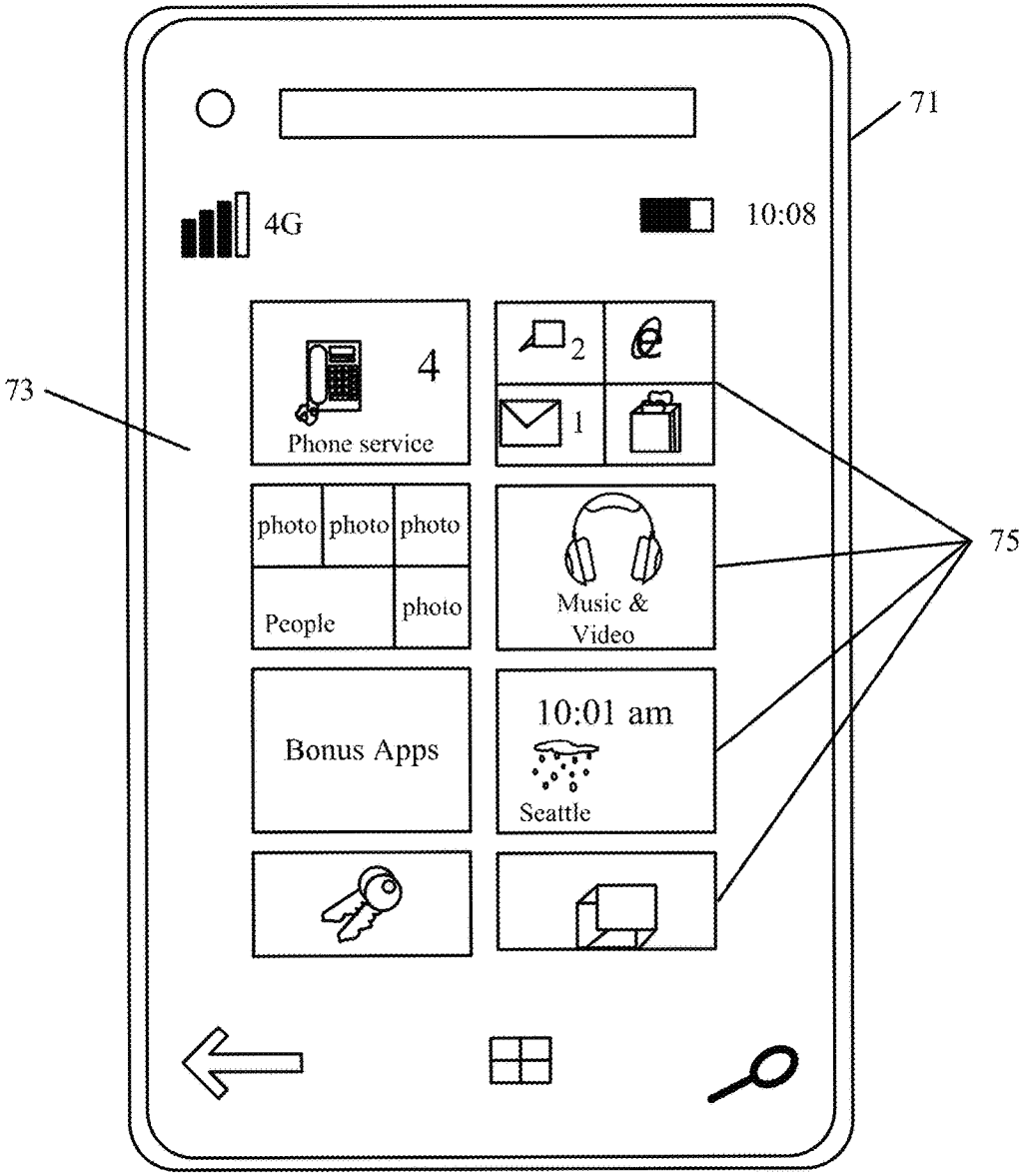

FIG. 8 is a simplified block diagram of one illustrative example of a handheld or mobile computing device that can be used as a user's or client's handheld device 16, in which the present system (or parts of it) can be deployed. For instance, a mobile device can be deployed in the operator compartment of work machine 100 for use in generating, processing, or displaying the damage avoidance data. FIGS. 9-10 are examples of handheld or mobile devices.

FIG. 8 provides a general block diagram of the components of a client device 16 that can run some components shown in previous FIGS., which interacts with them, or both. In the device 16, a communications link 13 is provided that allows the handheld device to communicate with other computing devices and under some examples provides a channel for receiving information automatically, such as by scanning. Examples of communications link 13 include allowing communication though one or more communication protocols, such as wireless services used to provide cellular access to a network, as well as protocols that provide local wireless connections to networks.

In other examples, applications can be received on a removable Secure Digital (SD) card that is connected to an interface 15. Interface 15 and communication links 13 communicate with a processor 17 (which can also embody processors or servers from previous FIGS.) along a bus 19 that is also connected to memory 21 and input/output (I/O) components 23, as well as clock 25 and location system 27.

I/O components 23, in one example, are provided to facilitate input and output operations. I/O components 23 for various examples of the device 16 can include input components such as buttons, touch sensors, optical sensors, microphones, touch screens, proximity sensors, accelerometers, orientation sensors and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a dead reckoning system, a cellular triangulation system, or other positioning system. Location system 27 can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. Memory 21 can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

FIG. 9 shows one example in which device 16 is a tablet computer 600. In FIG. 9, computer 600 is shown with user interface display screen 602. Screen 602 can be a touch screen or a pen-enabled interface that receives inputs from a pen or stylus. Computer 600 can also use an on-screen virtual keyboard. Of course, computer 600 might also be attached to a keyboard or other user input device through a suitable attachment mechanism, such as a wireless link or USB port, for instance. Computer 600 can also illustratively receive voice inputs as well.

FIG. 10 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 11:
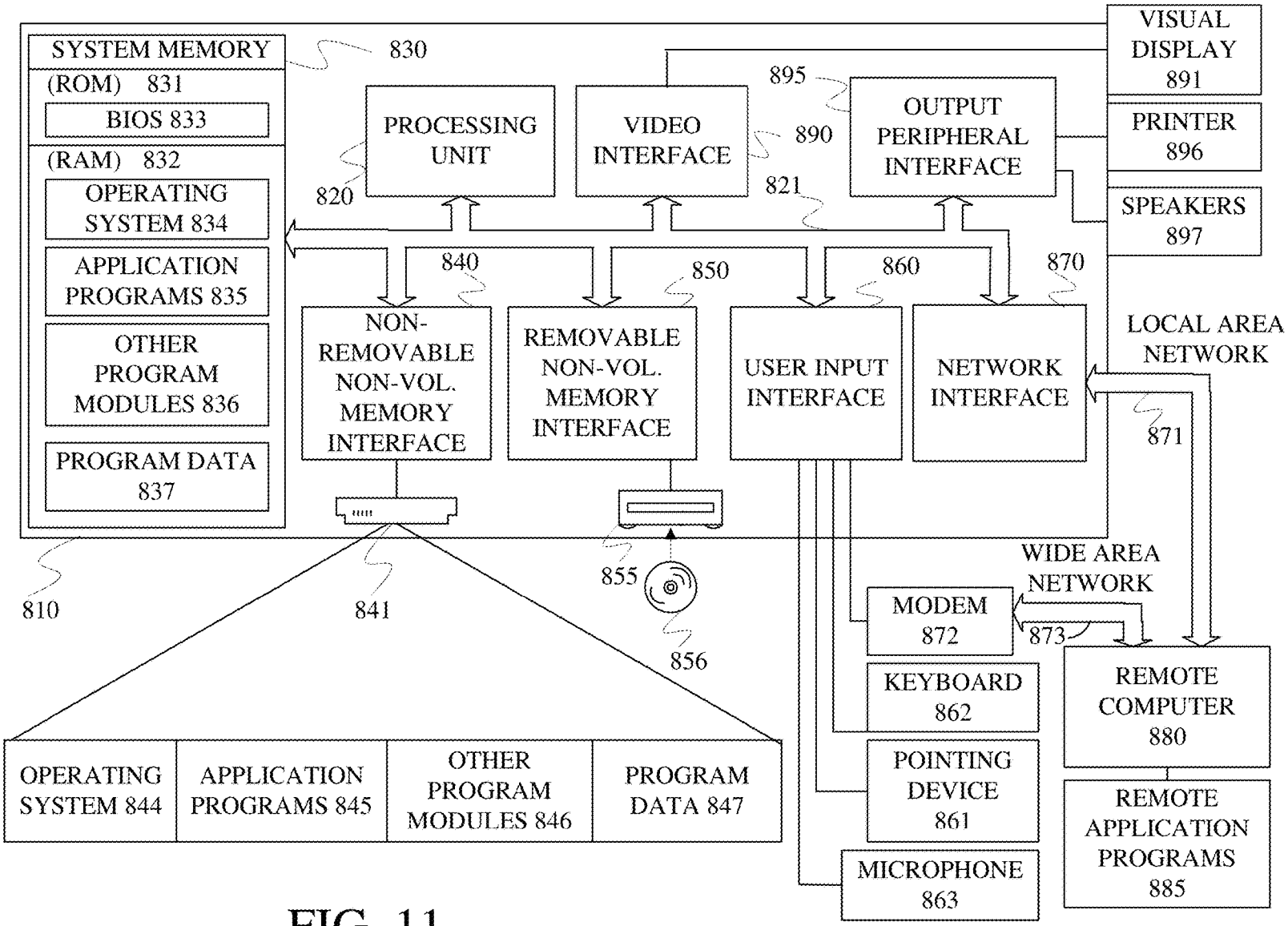
FIG. 11 is a block diagram showing one example of a computing environment that can be used in the architectures and systems described herein.

FIG. 11 is one example of a computing environment in which elements of previous FIGS., or parts of it, (for example) can be deployed. With reference to FIG. 11, an example system for implementing some embodiments includes a computing device in the form of a computer 810 programmed to operate as described above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to previous FIGS. can be deployed in corresponding portions of FIG. 11.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include a modulated data signal or carrier wave. Computer storage media includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 11 illustrates operating system 834, application programs 835, other program modules 836, and program data 837.

The computer 810 may also include other removable/non-removable volatile/nonvolatile computer storage media. By way of example only, FIG. 11 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 11, provide storage of computer readable instructions, data structures, program modules and other data for the computer 810. In FIG. 11, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 11 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A computer implemented method, comprising:

receiving a vision system input from a vision system, the vision system input being indicative of a field of view;

identifying, with an object endpoint detection system, a set of points corresponding to an object carried by an implement of a work machine based on the vision system input;

identifying, with the object endpoint detection system, from the set of points, a set of endpoints based on a distance that the endpoints are displaced from the implement; and generating, with a damage avoidance control signal generator, an actuator control signal to control movement of the object based on a location of the set of endpoints relative to the implement to avoid contact between the object and a protected portion of the work machine.

2. The computer implemented method of claim 1 wherein identifying the set of endpoints comprises:

identifying as a first endpoint of the set of endpoints a point located furthest from the implement on a first side of the implement; and identifying as a second endpoint of the set of endpoints a point located furthest from the implement on a second side of the implement.

3. The computer implemented method of claim 1 and further comprising:

determining whether the implement coupled to the work machine is carrying the object based on the vision system input; and generating an object presence signal indicative of whether the implement is carrying the object, wherein identifying the set of points corresponding to the object is performed based on the object presence signal.

4. The computer implemented method of claim 3 and further comprising:

determining whether the implement is in a position for object detection; and generating an implement position signal indicative of whether the implement is in the position for object detection, wherein determining whether the implement is carrying the object is performed based on the implement position signal.

5. A damage avoidance control system, comprising:

a vision system that generates a vision system signal indicative of a field of view captured by the vision system;

an object endpoint detection system that identifies a set of points corresponding to an object carried by an implement of a work machine based on the vision system signal and that identifies, from the set of points, a set of endpoints based on a distance that the endpoints are displaced from the implement; and a damage avoidance control signal generator that generates an actuator control signal to control movement of the object based on a location of the set of endpoints of the object relative to the implement to avoid contact between the object and a protected portion of the work machine.

6. The damage avoidance control system of claim 5 wherein the vision system comprises:

a stereo camera system.

7. The damage avoidance control system of claim 5 wherein the vision system comprises:

a radio detection and ranging (RADAR) sensing system.

8. The damage avoidance control system of claim 5 wherein the vision system comprises:

An infrared (IR) sensing system.

9. The damage avoidance control system of claim 5 wherein the vision system comprises:

a light detection and ranging (LIDAR) sensing system.

10. The damage avoidance control system of claim 5 wherein the vision system comprises:

an ultrasonic sensing system.

11. The damage avoidance control system of claim 5 and further comprising:

an object presence detection system configured to determine whether the implement coupled to the work machine is carrying the object based on the vision system signal and generate an object presence signal indicative of whether the implement is carrying the object.

12. The damage avoidance control system of claim 5 and further comprising:

an implement position detector configured to determine whether the implement is in a position for object detection and to generate an implement position signal indicative of whether the implement is in the position for object detection.

13. A work machine, comprising:

a machine frame;

an implement movably coupled to the machine frame;

an actuator configured to drive movement of the implement relative to the machine frame;

a vision system that generates a vision system signal indicative of a sensed field of view;

an object processing system that identifies a location of an endpoint of an object carried by the implement relative to the implement based on the vision system signal; and a control signal generator that generates an actuator control signal to control movement of the object to avoid contact between the of the object and a protected portion of the work machine based on the identified location of the endpoint of the object.

* * * * *